United States Patent [19]

Vierod et al.

[11] Patent Number: 5,026,433

[45] Date of Patent: Jun. 25, 1991

[54] GRAIN REFINEMENT OF A COPPER BASE ALLOY

[75] Inventors: Richard P. Vierod, Branford; Harvey P. Cheskis, North Haven; Derek E. Tyler, Cheshire, all of Conn.

[73] Assignee: Olin Corporation, Cheshire, Conn.

[21] Appl. No.: 459,885

[22] Filed: Jan. 2, 1990

[51] Int. Cl.[5] ..... C22C 9/00; C22F 1/08

[52] U.S. Cl. ..... 148/2; 75/652; 148/434; 148/11.5 C; 420/477; 420/496

[58] Field of Search ..... 75/76, 652; 420/496, 420/477; 148/434, 2, 11.5 C

[56] References Cited

U.S. PATENT DOCUMENTS

| | | | |
|---|---|---|---|
| 3,522,039 | 7/1970 | McLain | 420/496 |
| 3,522,112 | 7/1970 | McLain | 420/496 |
| 4,786,469 | 11/1988 | Weber et al. | 420/492 |

*Primary Examiner*—Deborah Yee

*Attorney, Agent, or Firm*—H. Samuel Kieser

[57] ABSTRACT

A method of producing a grain refined copper base alloy containing iron in the amount of less than 2.3% by weight and which is cast into an ingot by conventional direct chill casting. Calcium is added to the melt before casting, preferably in the form of a copper-clad or iron-clad calcium feedwire.

10 Claims, No Drawings

GRAIN REFINEMENT OF A COPPER BASE ALLOY

This invention relates to the grain refinement of a copper base alloy, and more particularly, to the grain refinement of a copper base alloy containing below 2.3% iron.

U.S. Pat. No. 3,522,039 discloses a copper base alloy containing iron. Additionally, in accordance with that patent, the alloy also contains relatively small amounts of phosphorus and zinc. A form of this alloy containing 2.1 to 2.6% iron, 0.05 to 0.20% zinc, and 0.01 to 0.04% phosphorus is known under the Unified Numbering System as Copper Alloy No. 19400.

This alloy is characterized by numerous advantages including good electrical conductivity, excellent annealing characteristics, and good tensile strength properties. As a result, this alloy has found application in the electronic industry for such items as electrical connectors, terminals, and lead frames. This is particularly true of such alloy containing iron in the lower ranges.

It has been found, however, that when the iron content is kept below 2.3% by weight, the alloy cast by the conventional direct chill casting process may exhibit a coarse, dendritic grain structure. This coarse grain structure may lead to the formation of cracks at high casting speeds. This can result in a reduction of manufacturing yields and an impairment of quality During conventional casting, when the iron content of the copper alloy is over 2.3% by weight, the above mentioned problems do not occur. This is due to the fact that in passing from the liquid to solid phase, there is a peritectic reaction which results in grain refinement during solidification. In this reaction, the first crystals formed are iron which act as a nucleus to form a very fine grain structure. With the iron content below the 2.3% level, there is no specific nuclei formed, and the resulting crystals are random and irregular, resulting in larger and coarser grain structure.

Accordingly, it is an object of the present invention to provide a method for casting a copper-iron alloy wherein the iron level is below 2.3% and which has a refined grain structure.

More specifically, it is an object of the Present invention to provide a method of casting a copper-iron alloy in which the iron content is below 2.3% in which the grain structure obtained during conventional casting is similar to that of the alloy having iron content over 2.3%.

A still further object of the invention is to provide a method of casting a copper alloy containing iron, zinc, and phosphorus wherein the iron content is below 2.3% and wherein the resulting cast structure is grain refined.

These and other objects of the present invention may be achieved through a process for casting a grain-refined, copper-iron alloy wherein the iron content is less than 2.3% by weight iron, wherein the process comprises providing a melt of a copper-iron alloy, adding an effective amount of calcium to the melt, and casting the melt containing the alloy and calcium in a mold to form an ingot.

The process of the present invention is generally directed to copper alloys having an iron content at the level of 2.3 weight percent or below. However, it is particularly adapted to alloys of the type disclosed in U.S. Pat. No. 3,522,039 having an iron content of 2.3% or less and also containing from 0.01 to 0.15% phosphorus, from 0.03 to 0.20% zinc. The preferred phosphorus content is from 0.03 to 0.10%, and the preferred zinc content is from 0.05 to 0.2% and optimumly from 0.1 to 0.2%.

In addition to the foregoing, small amounts of additional alloy ingredients may be, of course, included in order to achieve particularly desirable results——for example, aluminum, in an amount up to 0.07% and manganese in an amount up to 0.08%. Also, small amounts of impurities may, of course, be tolerated.

In accordance with the present invention, calcium is added to the melt before casting. The initial amount of calcium added to the melt should be an effective amount to result in grain refinement of the subsequent cast ingot. For this purpose, the calcium may be present in the amount of up to 0.10% and preferably in the range of 0.03 to about 0.05% by weight.

The calcium may be added in any convenient form such as by adding elemental calcium or by the addition of a copper-clad or iron-clad calcium feed wire. The calcium may be added after standard melting and alloying practices. It is preferred that the melt be at a temperature of at least 1,150° C. and preferably between about 1,200° C. to about 1,300° C. when the calcium is added. When the calcium is added as feedwire, a sufficient delay should be allowed prior to casting to insure complete dissolution of the feed wire in the melt.

After dissolution of the calcium in the melt, the melt may then be cast by the conventional direct chill casting process. In accordance with this process, the molten metal is fed into a bottomless mold. As the melt passes through the mold, a hardened shell forms against the interior wall of the mold with the interior of the cast metal in the mold being molten. As the ingot exits from the outlet section of the mold, water is sprayed on the sides of the ingot, cooling it and causing the contained molten metal to solidify.

After casting, the alloy may be conventionally treated as described in U.S. Pat. No. 3,522,039. According to that patent, the alloy may be hot rolled at an elevated temperature, i.e., from 800° C. to 1,050° C., with the temperature of about 950° C. being preferred. The alloy may then be cold rolled to gage with intermediate anneals, with cold reduction in excess of 50% between the anneals being preferred. The annealing temperatures preferred are from 400° C. to 600° C., with annealing time at temperature preferably being a minimum of two hours. Longer times may be utilized, if desired, for improved electrical conductivity. Continuous strand annealing of strip or mill products will achieve the same high level of physical properties as with Bell annealing, but will not achieve as high a level of electrical conductivity. Therefore, for development of both high anneal strength and electrical conductivity, final annealing and preferably in-process annealing must be in batches with conventional furnace cooling, such as Bell annealing.

Detail processing and preferred processing parameters, consistant with the foregoing, are disclosed in U.S. Pat. No. 3,522,122 entitled "Process for Treating Copper Base Alloy", issued July 28, 1970, in the name of C. D. McLain.

By way of example, following standard melting and alloying Practices, a 0.04% calcium addition in the form of an iron clad calcium feed wire was added to a melt containing a copper base alloy containing 2.2% iron. The melt had been equilibrated at a temperature of 1,225° C. A five minute delay was allowed to insure complete dissolution of the feed wire. The melt was then cast by the direct chill casting process in a 3"×8" cross sectional mold at a casting rate of 5 inches per minute. The resulting cast structure was grain refined throughout, with a mean grain size of 0.1 mm.

While the invention has been described above with reference to specific embodiments thereof, it is apparent that many changes, modifications, and variations can be made without departing from the inventive concept disclosed herein. AccordinglY, it is intended to embrace all such changes, modifications, and variations that fall within the spirit and broad scope of the appended claims. All Patent applications, patents, and other publications cited herein are incorporated by reference in their entirety.

What is claimed is:

1. A method of casting a grain refined copper-iron alloy, wherein the iron content is less than 2.3% by weight, said method comprising:

a. providing a melt of said copper-iron alloy, b. adding an effective amount of a component consisting essentially of calcium to said melt to result in grain refinement of the cast ingot, and c. casting said metal containing said calcium to form an ingot.

2. The method of claim 1, wherein said melt is cast utilizing the direct chill casting process.

3. The method of claim 1, wherein said alloy further contains from 0.01 to 0.15% phosphorus and from 0.03 to 0.20% zinc.

4. The method of claim 1, wherein said calcium is added to said melt in the amount up to 0.1% by weight.

5. The method of claim 4, wherein said calcium is added to said melt in the amount of from about 0.03 to about 0.05% by weight.

6. The process of claim 1, wherein said cast alloy is further processed by hot working said cast alloy at a temperature of from 800° C. to 1,050° C., and then cold rolling to gage with intermediate anneals, with cold reduction in excess of 50% between anneals and with an annealing temperature of from about 400° C. to 600° C.

7. The process of claim 3, wherein said cast alloy is further processed by hot working said cast alloy at a temperature of from 800° C. to 1,050° C., and then cold rolling to gage with intermediate anneals, with cold reduction in excess of 50% between anneals and with an annealing temperature of from about 400° C. to 600° C.

8. The process of claim 1, wherein said calcium is added in the form of copper-clad or iron-clad calcium feed wire.

9. The method of claim 8, wherein said alloy has been equilibriated at temperature of above 1,200° C. prior to the addition of the calcium.

10. A copper base alloy consisting of from about 1.5 to 2.3% iron, from 0.01 to 0.15% phosphorus, from 0.03 to 0.2% zinc, a residual amount of calcium which was added prior to the casting operation to provide grain refinement of the alloy after casting, and the balance copper, said alloy being grain refined throughout.

* * * * *